US005450627A

United States Patent [19]

Grilliot et al.

[11] Patent Number: 5,450,627

[45] Date of Patent: Sep. 19, 1995

[54] PROTECTIVE GARMENT CONTAINING LUMBAR SUPPORT MEANS

[76] Inventors: William L. Grilliot; Mary I. Grilliot, both of P.O. Box 14616, Dayton, Ohio 45414

[21] Appl. No.: 53,036

[22] Filed: Apr. 26, 1993

[51] Int. Cl.[6] ..... A41B 1/02

[52] U.S. Cl. ..... 2/81; 2/108; 2/85; 2/102; 2/227; 2/44

[58] Field of Search ..... 2/81, 44, 45, 85, 92, 2/93, 108, 95, 227, 230, 236, 237, 2, 69, 330, 94, 95, 102, 103, 69, 81; 297/465, 464; 128/846, 869, 870, 873, 874, 875; 602/19

[56] References Cited

U.S. PATENT DOCUMENTS

| | | | |
|---|---|---|---|
| 4,302,847 | 1/1981 | Miles | 2/2 |
| 4,999,850 | 3/1991 | Grilliot et al. | 2/93 |
| 5,105,474 | 4/1992 | Skinner | 2/227 |
| 5,157,790 | 10/1992 | Aldridge | 2/81 |
| 5,257,419 | 11/1993 | Alexander | 602/19 |
| 5,274,851 | 1/1994 | Simpkins, Sr. et al. | 2/108 |
| 5,351,340 | 10/1994 | Aldridge . | |

FOREIGN PATENT DOCUMENTS

| | | | |
|---|---|---|---|
| 2259848 | 3/1993 | United Kingdom | 2/338 |

*Primary Examiner*—Clifford D. Crowder
*Assistant Examiner*—Gloria Hale
*Attorney, Agent, or Firm*—Rockey, Rifkin and Ryther

[57] ABSTRACT

The present invention comprises a protective garment such as a firefighter's coat or trousers having a lumbar support belt attached to the innermost layer of the garment. As a result, no portion of the garment is disposed between the wearer of the garment and the lumbar support belt such that maximum support is achieved. The belt can be releasably secured to the garment such that it can be worn without the garment or the garment can be worn without the belt.

16 Claims, 4 Drawing Sheets

PROTECTIVE GARMENT CONTAINING LUMBAR SUPPORT MEANS

TECHNICAL FIELD

The present invention is an improved protective garment comprising a lumbar support belt incorporated therein.

BACKGROUND

The present invention pertains to the field of protective garments such as those used in the firefighting field and the like.

Garments to which the present invention pertains generally are constructed to have abrasion resistant qualities and heat insulative qualities. In addition, firefighting garments have been made to incorporate a moisture barrier material to help the garment resist moisture reaching the insulative material which would compromise its insulative action and indeed help conduct heat to the firefighter's body.

Protective garments of this type are quite heavy notwithstanding attempts to develop lighter component materials and garment constructions. Wearers of these garment also are often called upon to bear heavy loads in rescue operations, such as while extracting injured persons from collapsed or burning buildings. Firefighters are also often called upon to wear air tanks to supply breathable air during firefighting. Such loads increase the stress on the wearer, and often place increased loads on the back muscles and spine.

For these reasons, it is desirable to produce a protective garment that provides lumbar support to the wearer.

One of the disadvantages of simply donning a lumbar support belt over the garment is that the garment layers are thereby compressed which compromises their protective values, such as their insulative effect. Also, compressed garments are more vulnerable to the throughput of moisture which can also compromise insulative value, decreasing wearing comfort and increasing the risk of burning.

One attempt to incorporate lumbar support into a firefighting garment is represented by U.S. Pat. 5,157,790 to Aldridge. This patent teaches the incorporation of a lumbar support belt into a firefighting garment by attachment of the belt to the outer layer of a pair of firefighter's trousers. There are many disadvantages to this design including the fact that incorporating the belt within the garment layers causes compression of the garment layers, thereby reducing the insulative effectiveness of the garment and decreasing stress-reducing ventilation through the garment. Another disadvantage of this type of construction is that the additional material interposed between the belt and the wearer's back diminishes the firmness in support to be gained from the belt.

Accordingly, one of the objects of the present invention is to produce a protective garment which incorporates a lumbar support while avoiding the above-discussed deficiencies and disadvantages of the prior art.

Another object of the present invention is to provide a garment which contains a lumbar support belt and which allows the belt to be adjustable for the individual wearer.

It is still another object one the present invention to produce a lumbar support in a garment which, when disengaged, does not bind the wearer so as to increase discomfort and stress on the wearer.

Yet another object of the present invention is to provide a protective garment having the above-discussed qualities which is also easy and relatively inexpensive to produce; particularly one that can be produced from available lumbar support belts.

In light of the present disclosure or the practice of the present invention itself, additional advantages may become apparent to the wearer or one of ordinary skill in the relevant art.

SUMMARY OF THE INVENTION

The present invention comprises a protective garment with a lumbar support belt attached to the innermost layer of the garment.

In broadest terms, the present invention includes a firefighter's jacket adapted to provide lumbar support, the jacket having an inner surface and a portion of the inner surface covering the lumbar spine area, the jacket comprising: (1) at least one material having abrasion resistant, moisture resistant and thermal insulative qualities; and (2) a lumbar support belt attached to the portion of the inner surface of the jacket covering the lumbar spine area, and having no substantial portion of the garment disposed between the wearer and the belt (i.e. between the inside surface of the lumbar support belt and the wearer).

It is preferred that the lumbar support belt be releasably attached to the portion of the inner surface of the jacket covering the lumbar spine area. This may be accomplished by any appropriate releasable attachment means, such as snap closures, buttons, or hook-and-loop closures such as velcro, or other equivalent means.

It is also preferred that the lumbar support belt be releasably attached to the portion of the inner surface of the jacket covering the lumbar spine area so as to be vertically adjustable along the axis and within the lumbar spine area. This may be done by providing a series of buttons or snaps on the belt with a larger series of button holes or corresponding snap portions, respectively, along the inner layer of the garment, which allows selective attachment of the lumbar support belt at various heights within the jacket. Another way of accomplishing this feature is to provide a portion of a hook-and-loop type closure means, such as a strip of velcro, onto the lumbar support belt, and another, larger portion on the inner surface of the jacket (i.e. providing greater extension along the vertical axis of the garment), so that the lumbar support belt can be attached at various heights within the garment. This feature allows for custom fitting of the lumbar support belt within the garment to suit the needs of the individual wearer.

It is also preferred that the lumbar support belt additionally include shoulder straps attached thereto. The optional shoulder straps may be attached by any appropriate means, such as through the use of stitching, buckles, snaps, buttons or equivalent attachment means.

The present invention also includes protective trousers adapted to provide lumbar support. The trousers have an inner surface, a portion of the inner surface covering the lumbar spine area. In broadest terms, the trousers comprise: (1) at least one material having abrasion resistant, moisture resistant and thermal insulative qualities; and (2) a lumbar support belt attached to the portion of the inner surface of the trousers covering the lumbar spine area, and having no substantial portion of the garment disposed between the wearer and the belt (i.e. between the inside surface of the lumbar support belt and the wearer).

It is preferred that the lumbar support belt be releasably attached to the portion of the inner surface of the trousers covering the lumbar spine area. This may be accomplished by any appropriate releasable attachment means, such as snap closures, buttons, or hook-and-loop closures such as velcro, or any other equivalent means.

It is also preferred that the lumbar support belt be releasably attached to the portion of the inner surface of the trousers covering the lumbar spine area so as to be vertically adjustable along the axis and within the lumbar spine area. This may be done by providing a series of buttons or snaps on the belt with a larger series of button holes or corresponding snap portions, respectively, along the inner layer of the garment, which allows selective attachment of the lumbar support belt at various heights within the trousers. Another way of accomplishing this feature is to provide a portion of a hook-and-loop type closure means, such as a strip of VELCRO, onto the lumbar support belt, and another, larger portion on the inner surface of the trousers (i.e. providing greater extension along the vertical axis of the garment), so that the lumbar support belt can be attached at various heights within the garment. This feature allows for custom fitting of the lumbar support belt within the garment to suit the needs of the individual wearer.

The garments of the present invention may also include other protective garments or garment portions such as one piece protective suits, protective vests, etc., having corresponding lumbar portions with a limbar support belt releasably attached thereto as is described with respect to a jacket or trousers above.

Although not limited to the number of layers in the protective garment, typical firefighting garments are constructed of an abrasion-resistant outer layer, such as Nomex Duck or Twill Weave or PBI rip-stop material; an intermediate layer of a moisture barrier material such as Goretex ® or neoprene; and an inner layer of a thermal insulative material such as Quilt Batt, Dupont ® E-89, or Pleat-Pak or Aralite material commercially available from Southern Mills of Atlanta, Ga.

DETAILED DESCRIPTION OF THE PREFERRED EMBODIMENT

In accordance with the foregoing summary of the invention, the following presents a preferred embodiment of the present invention which is also presently considered to be the best mode of the invention.

Figure 1:
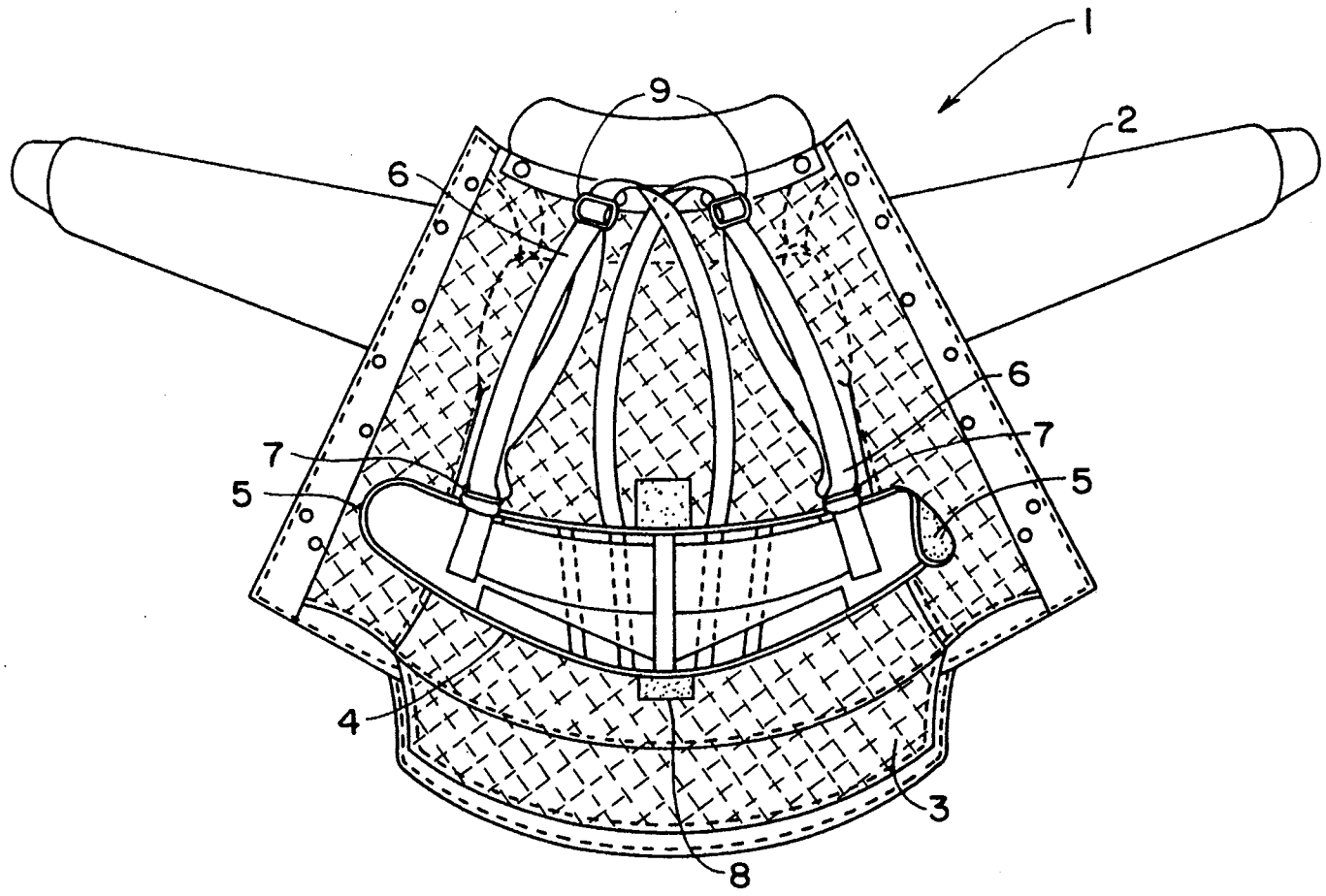
FIG. 1 shows a jacket in accordance with one embodiment of the present invention, opened to show the position and attachment of a lumbar support belt.

FIG. 1 shows jacket 1 in accordance with one embodiment of the present invention. Jacket 1 is shown as having an outer abrasion resistant layer 2 and an inner layer 3, such as an inner thermal layer or liner. To inner layer 3 is attached lumbar support belt 4 which is closed by hook-and-loop means 5. Lumbar support belt 4 is also shown as having attached thereto optional shoulder straps 6 attached to lumbar support belt 4 by metal buckles 7, and containing adjustment buckles 9. The lumbar support belt is thereby positioned so that there are no intervening layers of garment material between the wearer and the inner surface of the lumbar support belt.

The lumbar support belt 4 is attached by means of a VELCRO closure; the first half of which (item 8) is mounted on the inner surface of the garment (i.e. inner layer 3) and the other half mounted on the outer surface of the lumbar support belt 4 (not shown). It is most preferred that the attachment means be adapted to allow the lumbar support belt to be vertically adjustable. This may be accomplished by providing that the inner layer half of the attachment means (or series of attachment means such as a series of snaps or buttons as an alternative) extends along the vertical axis of the jacket so that the lumbar support belt 4 may be attached at various heights within the jacket.

Figure 2:
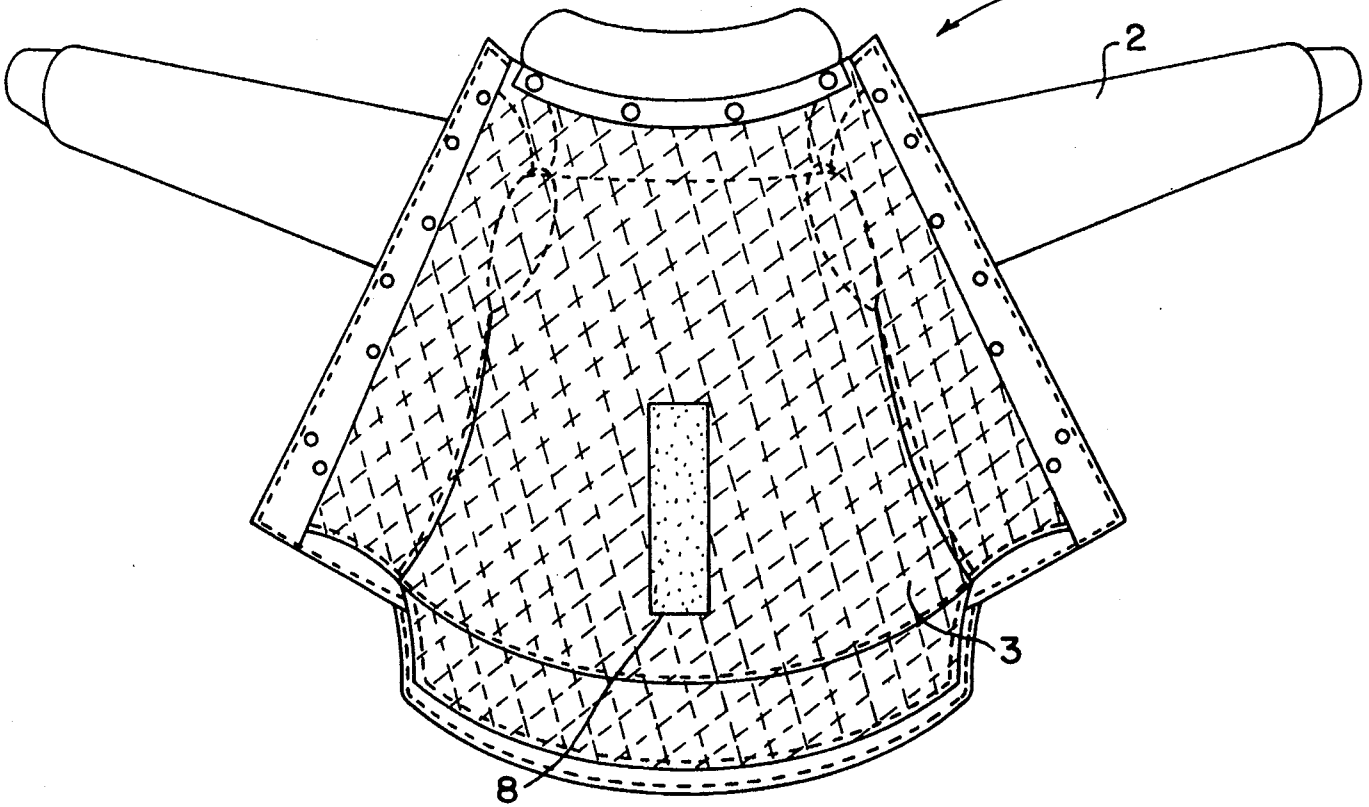
FIG. 2 shows a jacket in accordance with one embodiment of the present invention, opened to show the position of the attachment means once the lumbar support belt has been removed.

FIG. 2 shows jacket 1 as shown in FIG. 1 but showing the jacket as it would appear with the lumbar support belt removed. The numbered portions of the jacket are as described with respect to FIG. 1.

Figure 3:
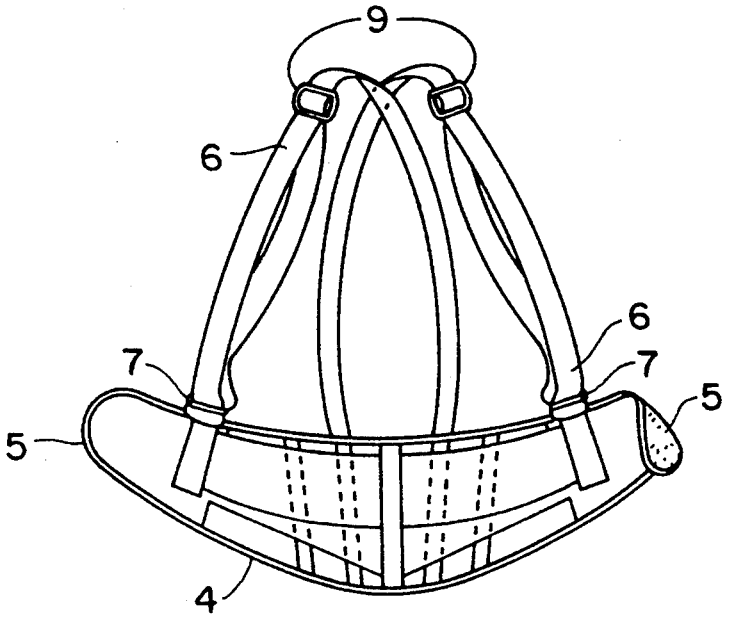
FIG. 3 shows a lumbar support belt used in accordance with one embodiment of the present invention, detached from a garment in accordance with the invention.

FIG. 3 shows a lumbar support belt 4 used in accordance with this embodiment of the present invention, as it would appear when detached from a garment in accordance with the invention. The numbered portions of the lumbar support belt are as described with respect to FIG. 1.

Figure 4:
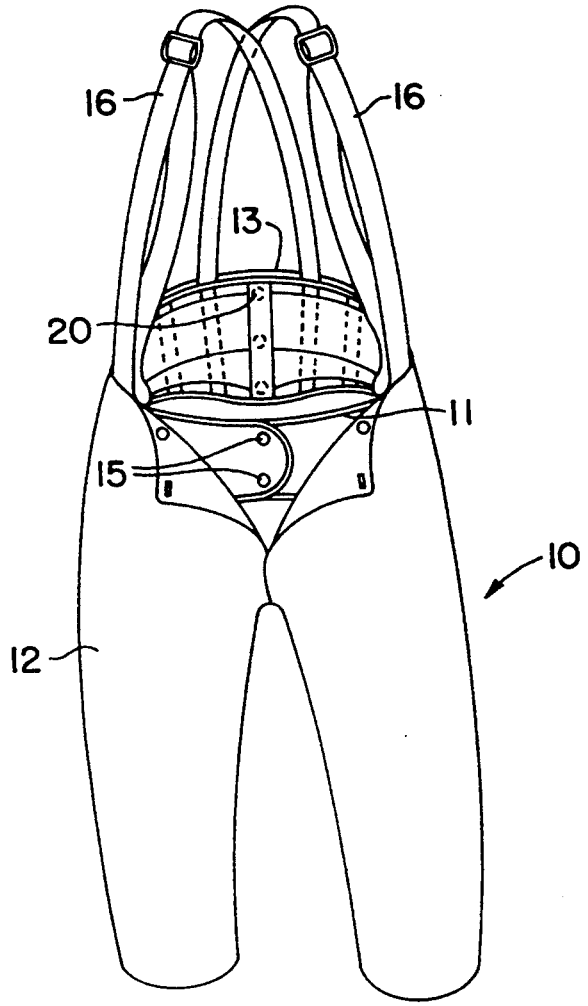
FIG. 4 shows a pair of trousers in accordance with a second embodiment of the present invention, opened to show the position and attachment of a lumbar support belt in the closed position.

FIG. 4 shows a pair of trousers 10 in accordance with a second embodiment of the present invention, and opened to show the position and attachment of a lumbar support belt 11.

Trousers 10 are shown as having an outer abrasion resistant layer 12 and an inner layer 13, such as an inner thermal layer or liner. To inner layer 13 is attached lumbar support belt 11 which is closed by buttons 15. Lumbar support belt 11 is also shown as having attached thereto optional shoulder straps 16 attached to lumbar support belt 11 by metal buckles 17 (see FIG. 5), and containing adjustment buckles 19. The lumbar support belt is thereby positioned so that there are no intervening layers of garment material between the wearer and the inner surface of the lumbar support belt.

The lumbar support belt 11 is attached to the inner surface of the trousers by means of buttons and button holes; the button holes 18 are formed into the inner layer 13 (see FIG. 5) and the buttons 20 are mounted on the outer surface of the lumbar support belt 11. It is most preferred that the attachment means be adapted to allow the lumbar support belt to be vertically adjustable. This may be accomplished by providing that the inner layer portion of the attachment means (i.e. a series of attachment means such as a series of snaps or buttons;

or velcro strips as an alternative described above) extends along the vertical axis of the trousers so that the lumbar support belt 11 may be attached at various heights within the trousers.

Figure 5:
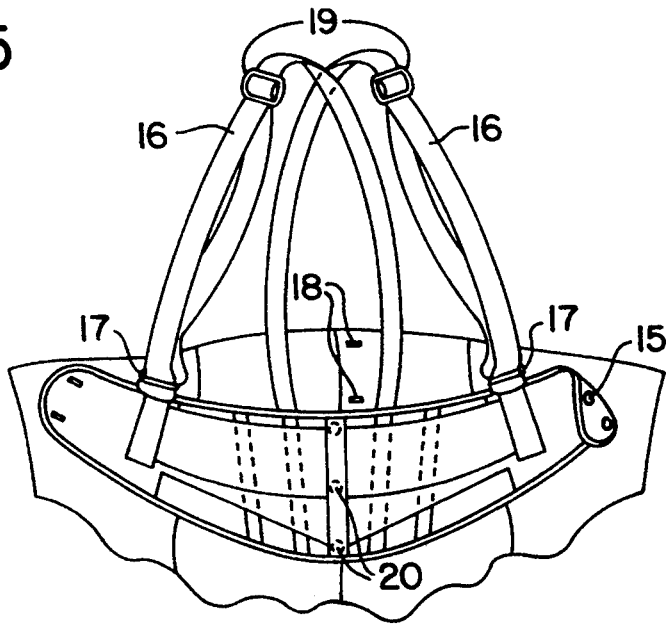
FIG. 5 shows a sectioned portion of a pair of trousers in accordance with a second embodiment of the present invention, opened to show in more detail the position of the attachment means and the lumbar support belt.

FIG. 5 shows a sectioned view of pair of trousers in accordance with a second embodiment of the present invention, and opened to show the position of the attachment means (i.e. a series of vertically arranged button holes 18) and the lumbar support belt 11 attached thereto by a corresponding series of buttons 20 on the outside surface of the lumbar support belt 11.

In view of the present disclosure, it will be within the ability of one skilled in this art to make modifications and alterations, including those made through the substitution of equivalent materials and the integration or disintegration of elements of the invention, without departing from the spirit of the invention as reflected in the appended claims.

What is claimed is:

1. A protective jacket such as for firefighting, comprising:

a) an outer shell;

b) a liner located inside of the outer shell having an outer surface facing the outer shell and an inner surface facing the wearer of the jacket;

c) a lumbar support belt located adjacent the inner surface of the liner in a lumbar spine area and exposed to the wearer of the Jacket such that no layer of the jacket is disposed between the belt and the wearer; and d) means for securing the belt to the inner surface.

2. The protective jacket according to claim 1, wherein the means for securing is releasable whereby the belt can be removed from the liner.

3. The protective jacket according to claim 2 wherein said means for securing includes hook and loop fasteners.

4. The protective jacket according to claim 1, wherein said jacket has a vertical axis passing through said lumbar spine area, wherein said lumbar support belt is attached to said portion of said inner surface covering said lumbar spine area so as to be vertically adjustable along said axis and within said lumbar spine area.

5. The protective jacket according to claim 4 wherein said lumbar support belt is releasably attached to said inner surface by hook and loop attachment means.

6. A protective jacket according to claim 1, wherein said lumbar support belt additionally comprises shoulder straps attached to said lumbar support belt.

7. Protective trousers such as for firefighting, comprising:

a) an outer shell;

b) a liner located inside of the outer shell having an outer surface facing the outer shell and an inner surface facing the wearer of the trousers;

c) a lumbar support belt located adjacent the inner surface of the liner in a lumbar spine area and exposed to the wearer of the trousers such that no layer of the trousers is disposed between the belt and the wearer; and d) means for securing the belt to the inner surface.

8. Protective trousers according to claim 7 wherein the means for securing is releasable whereby the belt can be removed from the liner.

9. Protective trousers according to claim 8 wherein the means for securing includes hook and loop fasteners.

10. The protective trousers according to claim 7, wherein said trousers has a vertical axis passing through said lumbar spine area, wherein said lumbar support belt is attached to said portion of said inner surface covering said lumbar spine area so as to be vertically adjustable along said axis and within said lumbar spine area.

11. The protective trousers according to claim 10, wherein said lumbar support belt is releasably attached to said inner surface by hook and loop attachment means.

12. A protective trousers according to claim 7, wherein said lumbar support belt additionally comprises shoulder straps attached to said lumbar support belt.

13. A protective garment such as for firefighting, comprising:

a) an outer shell;

b) a liner located inside of the outer shell having an outer surface facing the outer shell and an inner surface facing the wearer of the garment;

c) a lumbar support belt located adjacent the inner surface of the liner in a lumbar spine area and exposed to the wearer of the garment such that no layer of the garment is disposed between the belt and the wearer; and d) means for securing the belt to the inner surface.

14. The protective garment according to claim 12, wherein said garment has a vertical axis passing through said lumbar spine area, wherein said lumbar support belt is attached to said portion of said inner surface covering said lumbar spine area so as to be vertically adjustable along said axis and within said lumbar spine area.

15. The protective garment according to claim 12, wherein said lumbar support belt is releasably attached to said inner surface by hook and loop attachment means.

16. A protective garment according to claim 12, wherein said lumbar support belt additionally comprises shoulder straps attached to said lumbar support belt.

* * * * *

UNITED STATES PATENT AND TRADEMARK OFFICE

CERTIFICATE OF CORRECTION

PATENT NO.: 5,450,627

DATED : Sept. 19,1995

INVENTOR(S): William L. Grilliot; Mary I. Grilliot

It is hereby certified that error appear(s) in the above-identified patent and that said Letters Patent are hereby corrected as shown below:

Column 2, line 25, "garment" should read – –garments– –.

Column 2, line 67, "one" should read – –of– –.

Claim 10, line 2, "has" should read – –have– –.

Signed and Sealed this

Fifteenth Day of May, 2001

*Attest:*

Nicholas P. Godici

NICHOLAS P. GODICI

*Attesting Officer*

*Acting Director of the United States Patent and Trademark Office*